US008472633B2

(12) United States Patent
Krantz et al.

(10) Patent No.: US 8,472,633 B2
(45) Date of Patent: Jun. 25, 2013

(54) DETECTION OF DEVICE CONFIGURATION

(75) Inventors: Anton W. Krantz, Kirkland, WA (US); William L. Looney, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 1628 days.

(21) Appl. No.: 11/273,958

(22) Filed: Nov. 15, 2005

(65) Prior Publication Data

US 2007/0110251 A1 May 17, 2007

(51) Int. Cl.
*H04R 29/00* (2006.01)

(52) U.S. Cl.
USPC ..... 381/58; 381/77; 381/91; 381/92; 381/108; 381/122; 381/123; 700/94

(58) Field of Classification Search
USPC ..... 381/58, 333, 77, 92, 91, 122, 123, 381/108; 700/94
See application file for complete search history.

(56) References Cited

U.S. PATENT DOCUMENTS

| | | | | |
|---|---|---|---|---|
| 6,016,136 | A * | 1/2000 | Fado et al. | 715/721 |
| 2005/0042591 | A1 * | 2/2005 | Bloom et al. | 434/307 A |
| 2005/0175190 | A1 * | 8/2005 | Tashev et al. | 381/92 |
| 2006/0039568 | A1 * | 2/2006 | Lee et al. | 381/59 |
| 2006/0112335 | A1 * | 5/2006 | Hofmeister et al. | 715/701 |

* cited by examiner

*Primary Examiner* — Vivian Chin
*Assistant Examiner* — Paul Kim

(57) ABSTRACT

Devices connected with a computer system are interrogated to detect whether they are configured and functioning. In an audio device implementation, a known audio sample is output to a loudspeaker. If the loudspeaker is properly configured and functional, an attached microphone will capture the sound corresponding to the audio sample generated by the loudspeaker. If sound corresponding to the audio sample is detected, an indication is provided to the user that the microphone and loudspeaker are operational. If no sound corresponding to the audio sample is detected, an indication is provided to the user that the loudspeaker is not enabled and additional configuration is required.

19 Claims, 5 Drawing Sheets

DETECTION OF DEVICE CONFIGURATION

BACKGROUND

Real-time communication using network-connected computing devices is becoming increasingly popular. This may take the form of, for example, voice over Internet protocol (VOIP) telephony, audio-enabled chat programs, and audio and video streaming. Providing the highest quality audio and/or video experience can be a differentiator among the many companies providing real-time communication audio clients. A real-time audio client typically requires a user to select and configure the audio devices to use for making a call. However, the user's selection does not guarantee that the audio devices are receiving or playing audio. Present configuration processes on audio clients only check a portion of the overall audio system. Thus, for example, the audio client can determine that it is sending a sound sample to a loudspeaker, but cannot determine whether the loudspeaker is actually playing the sound. Similarly, the audio client may test to determine whether the microphone is working by asking a user to speak into the microphone, but the audio client has no way of knowing whether the user actually responded if no signal is recorded within a certain period of time.

The information included in this Background section of the specification is included for technical reference purposes and is not to be regarded as subject matter by which the scope of the invention is to be bound.

SUMMARY

The technology described and claimed herein is directed to detecting whether particular output or input devices of a computer system are configured and operational. In an audio device implementation, for example, when configuring devices for conducting real-time audio communications or other audio input and output to the computer system, a microphone and a loudspeaker are interrogated to detect whether they are correctly installed. A known audio sample is then output to the attached loudspeaker. If the loudspeaker is properly configured and functional, the microphone will capture the sound corresponding to the audio sample generated by the loudspeaker. If sound corresponding to the audio sample is detected and validated, an indication is provided to the user that the microphone and loudspeaker are operational. If no sound corresponding to the audio sample is detected, an indication is provided to the user that the loudspeaker is not enabled. The user may be instructed to troubleshoot the loudspeaker configuration or to select an alternate microphone/loudspeaker device combination for use during the communication session. Alternatively, the detection process may automatically iterate through each combination of microphone and loudspeaker attached to the computer system until a functional match is determined. A similar detection process may be undertaken with respect to determining the functionality of the microphone and is described in greater detail herein.

In some implementations, articles of manufacture are provided as computer program products. One implementation of a computer program product provides a computer program storage medium readable by a computer system and encoding a computer program. Another implementation of a computer program product may be provided in a computer data signal embodied in a carrier wave by a computer system and encoding the computer program. This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various embodiments and implementations as further illustrated in the accompanying drawings and defined in the appended claims.

BRIEF DESCRIPTIONS OF THE DRAWINGS

DETAILED DESCRIPTIONS

An implementation of the technology described herein provides for the automatic detection of input device and output device configuration. This technology aids a user of a computer system conducting real-time communications, audio capture, audio emission or playback, or other audio communication sessions to ensure that the devices necessary to conduct such sessions are configured and thus operational.

For example, when conducting an audio conference, e.g., a VOIP telephone call using a personal computer system, both an audio input device and an audio rendering device, e.g., one or more loudspeakers are necessary to conduct a communication session. If either or both of the microphone and loudspeakers are not configured properly, a user will be unable to participate in the communication session. The systems and methods described herein function as an automatic aid to a user of the computer system to either confirm the functionality of the peripheral devices or to indicate which particular devices are not functioning and thus likely improperly configured or otherwise not operational.

Figure 1:
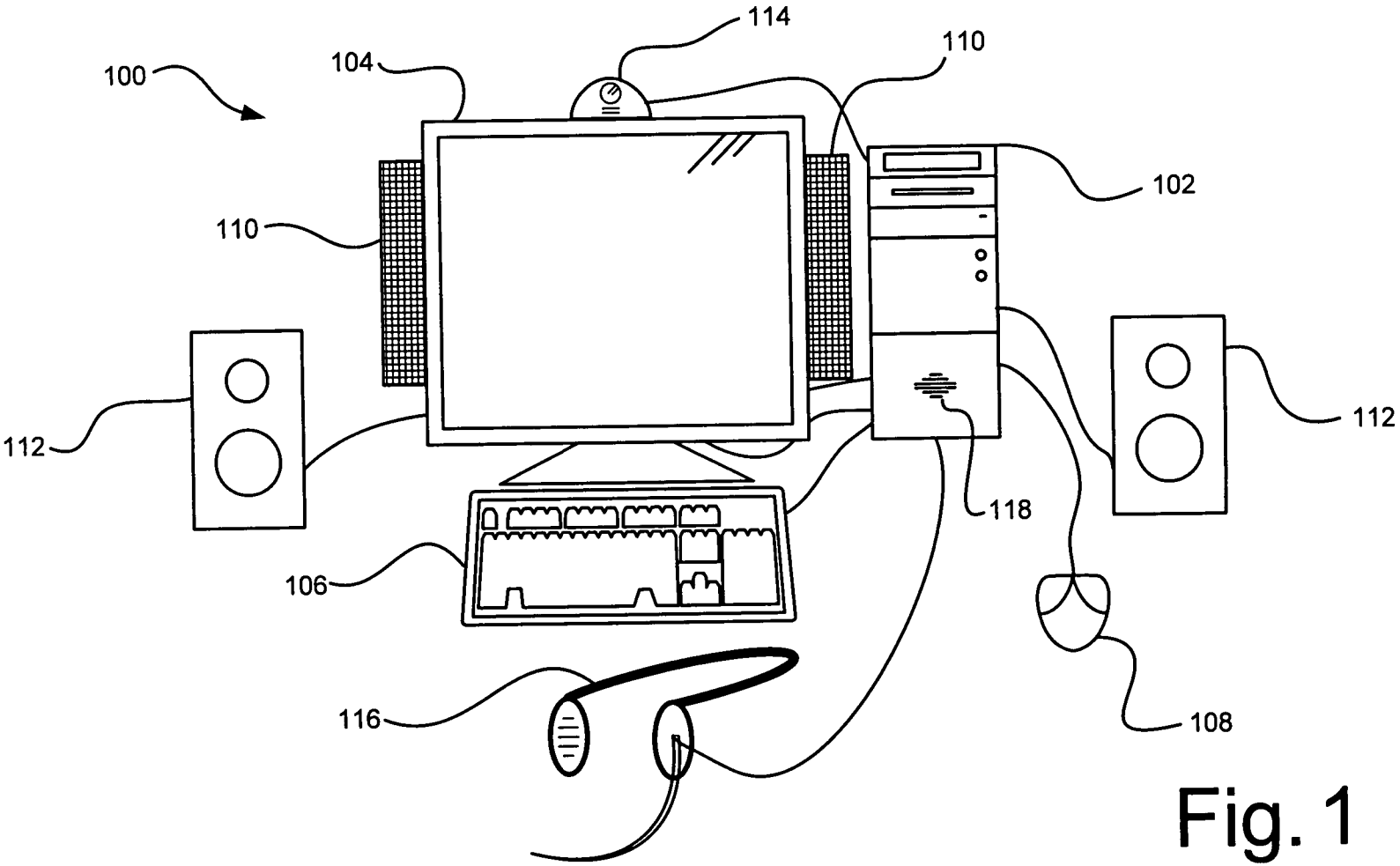
FIG. 1 depicts an exemplary personal computer system with a plurality of attached audio devices.

In an exemplary audio configuration, the functionality of audio devices, e.g., microphones and loudspeakers, connected with a computer system may be detected and confirmed. As depicted in FIG. 1, a personal computer system 100 may be equipped with a variety of peripheral devices that may include audio functionality. A typical personal computer system 100 may include a computer 102 and a video monitor 104, a keyboard 106, and a mouse 108 connected to the computer 102. The computer 102 may have a built-in loudspeaker 118 for producing sound. The video monitor 104 may also be equipped with a pair of loudspeakers 10. Further, the user of the personal computer system 100 may also attach a set of external loudspeakers 112 to the computer 102. The personal computer system 100 may also include a combination video camera and microphone 114 for conducting Internet video conferences. The user may also attach a headset 116 that combines earphone loudspeakers and a microphone for participating in VOIP or Internet video conferences.

A sample audio file may be output through a loudspeaker device connected with the computer system. The sample audio file may be stored in memory associated with the computer system or may be accessed from a remote computer system over a network. The sample audio file may be transformed into an analog signal and transmitted to the loudspeaker. Alternatively, an audio signal could be generated contemporaneously according to an instruction set. In an instance where the loudspeaker is digital, i.e., the loudspeaker has an analog-to-digital converter, the sample audio file may be transmitted directly to the loudspeaker. The loudspeaker transduces the analog audio signal to acoustic energy to create sound waves in the atmosphere.

A test is performed to record sounds received by the microphone during the same time period that the sample audio file is played by the loudspeaker. Any sound waves, including sound corresponding to the sample audio file, are picked up by the microphone and likewise transduced into an analog audio signal. The analog audio signal is transformed by the computer system into a digital data format. Alternatively, in the case of a digital microphone, the soundwaves may be immediately converted into a digital signal for input to the computer.

The audio data captured by the microphone and the sample audio file are converted into a common data format if necessary. The audio data from the captured sounds is compared with the audio data from the known sample audio file to determine whether there is a reasonable correlation between the audio data. If there is a reasonable correlation, the selected audio devices are presumed to be properly configured and functional. If there is no correlation, the computer system may either indicate to the user that one or more of chosen audio devices is not functioning or automatically choose other combinations of attached audio devices to detect an operational combination.

Figure 2:
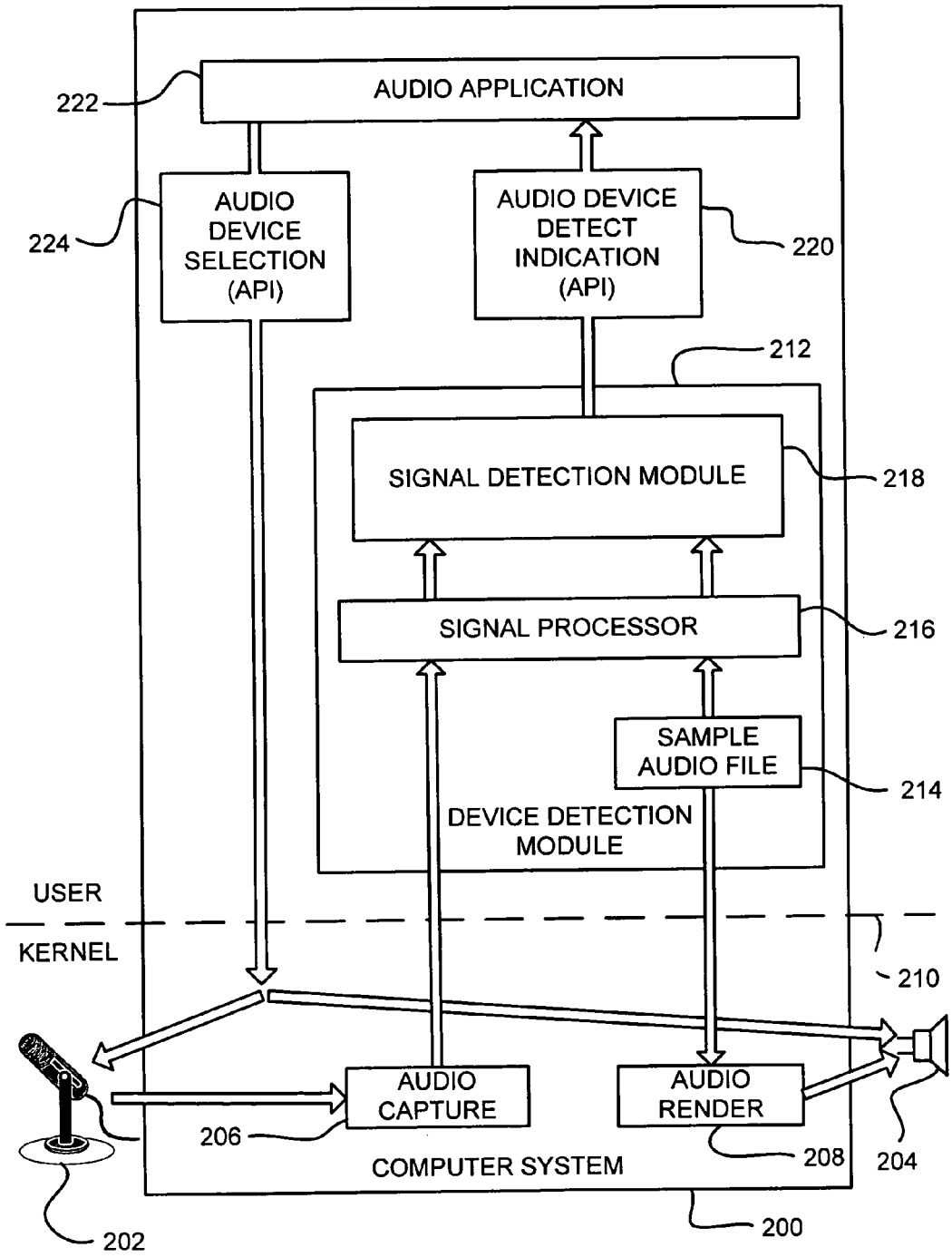
FIG. 2 illustrates exemplary modules in a computer system for detecting device configuration.

An exemplary computer system 200 with components and modules for implementing the automatic detection technology is depicted in FIG. 2. Two exemplary peripheral devices, a microphone 202 and a loudspeaker 204, are connected with the computer system 200. The microphone 202 may be connected to the computer system 200 as an input device to an audio capture module 206. The loudspeaker 204 may be connected to the computer system 200 as an output device to an audio rendering module 208.

The microphone 202 may be a hardware device internal to the computer system 200 or an external device connected to the computer system 200 via a wired or wireless connection. Similarly, the loudspeaker 204 may be a hardware device internal to the computer system 200 or an external device connected to the computer system 200 via a wired or wireless connection. The loudspeaker 204 may be a single speaker, a pair of speakers, or a system of a plurality of speakers, for example, in a "surround sound" configuration. Alternatively, the microphone 202 and loudspeaker 204 may be combined in a single device, for example, a telephone handset or a headset.

As shown in FIG. 2, the automatic device configuration detection functionality may be implemented by a combination of resource and instruction levels of the computer system 200, for example, with resources in both a kernel and a user-mode of the computer system 200 as indicated by the dashed line 210. In other operating systems and computing environments, such components and modules may be controlled at other levels of the software architecture. The kernel manages the machine's hardware resources, including the processor and the memory, and low-level hardware interfaces, and controls the way other software components, for example, user-mode components, can access these resources, for example, through device drivers, memory management routines, the scheduler, and system calls.

The audio capture module 206 and the audio render module 208 may both reside in the kernel. The audio capture module 206 converts analog audio signals generated by the microphone 202 from sound waves into digital data signals, e.g., pulse code modulated (PCM) data, compact disc raw (CDR) data, or other common data formats for further processing by the computer system 200. The PCM data may be of various qualities, for example, PCM 16, PCM 32, or PCM 48. The audio rendering module 208 converts digital audio files, for example, in waveform (WAV), MPEG1, digital sound module (DSM) audio format, or other common data formats, into analog audio signals for acoustic rendering by the loudspeaker 204.

Additional functionality is implemented in the user-mode as software processing routines that operate on the audio data received by the microphone 202 and the audio capture module 206, as well as other data. A device detection module 212 includes a sample audio file 214, a signal processor 216, and a signal detection module 218. The sample audio file 214 may be accessed by operations performed by the device detection module 212 and transmitted to either or both the audio rendering module 208 and the signal processor 216. The sample audio file 214 is transmitted to the audio rendering module 208 as a known audio sample for output to the loudspeaker 204 in order to test the configuration and functionality of the loudspeaker 204.

The sample audio file 214 may be a digital audio file, e.g., a WAV file, that is chosen for attributes of the sound produced. For example, the sample audio file 214 may produce a sound that includes a particular range of frequencies that are easy to detect through the microphone 202. The sample audio file 214 may additionally be chosen to generate a sound pleasing to hear by a user, for example, a musical sequence, or provide information valuable to the user, for example, configuration instructions or an advertisement.

Audio signals received from the microphone 202 are also transmitted from the audio capture module 206 to the signal processor 216. Either or both of the audio signals from the audio capture module 206 and the sample audio file 214 may be processed by the signal processor 216 in order to transform the audio signals into a common data format for purposes of comparison of the audio signals. Audio signals (and other digital data signals) may be converted to and stored in any format. For example, if the audio signal from the audio capture module 206 is in PCM format and the audio sample file 214 is in WAV format, the audio sample file 214 may be converted by the signal processor 216 into PCM format. Alternately, the audio signal from the audio capture module 206 may be converted by the signal processor into a WAV format. In yet another instance, both the audio signal from the audio capture module 206 and the audio sample file 214 may be transformed by the signal processor 216 into a third format, e.g., audio interchange file format (AIFF), in the event that such a format would aid in further processing by the device detection module 212.

Once either or both of the audio signal from the audio capture module 206 and the audio sample file 214 are processed by the signal processor 216, the captured audio signals are detected and compared by the signal detection module 218. At a first level, detection of any audio signal from the audio capture module 206 is desirable to confirm that the microphone 202 is indeed configured and functional.

Detection of a signal processed by the signal processor 216 by directly accessing the sample audio file 214 is also desirable to confirm that the sample audio file 214 is still stored within and accessible by the device detection module 212 and has not been corrupted, deleted, removed, or relocated. If the sample audio file 214 were inaccessible, the test audio sounds would not be generated by the loudspeaker 204 to be detected at the microphone 202. Thus, initially, the detection of data directly from the sample audio file 214 may function as a check in the integrity of the device detection module 212 and its ability to compare the captured audio signal to a known audio sample.

At a second level, comparison of the audio signal from the audio capture module 206 with the audio sample file 214 is desirable to confirm that the loudspeaker 204 is in fact working. For example, if some sound is generally picked up by the microphone 202, the signal detection module 218 would conclude that the microphone 202 is properly configured, but would not be able to discern whether the sounds picked up by the microphone 202 were generated by the loudspeaker 204 or were merely ambient sounds of the environment in which the microphone 202 is located. The ability to discern whether sound transduced by the microphone 202 originated with the loudspeaker 204 may be aided by capturing and recording an audio signal from the microphone 202 during a particular window of time within which the sample audio file 214 should be played by the loudspeaker 204. Thus the signal detection module 218 compares characteristics, for example, frequency, intensity, and timing, of the data corresponding to the audio signal from the audio capture module 206 with the data from the audio sample file 214 to determine whether there is a match in the data. If the data do correlate, the signal detection module 218 confirms that both the microphone 202 and loudspeaker 204 are functional.

As shown in FIG. 2, the computer system 200 also includes an audio application 222 operating within the user-mode. The audio application 222 may be a software program instantiated by the user that will control the input and output devices being configured, e.g., the microphone 202 and the loudspeaker 204. An exemplary audio application may be a VOIP client or an audio-enabled chat program. Alternately, the audio application 222 may merely be an audio device configuration program, e.g., a "wizard" program instantiated to install a new audio device or optimize the features of a previously installed audio device.

An "audio device detect indication" 220 application program interface (API) acts as an interface between the signal detection module 218 in the device detection module 212 to transfer data indicating whether there are any device configuration issues to the audio application 222. The audio application 222 may use the data from the audio device detect indication API 220 to communicate information about the audio device configuration to the user. For example, if the indication is that the loudspeaker 204 was not detected, the audio application 222 may alert the user to troubleshoot the loudspeaker 204 or to select another loudspeaker option (e.g., switch from an external loudspeaker set to alternative loudspeakers built-in to an attached monitor to determine whether the alternative speakers are functional). In one exemplary form, the audio application 222 may provide an alert to the user through a message in a graphical user interface (GUI) (e.g., a "pop-up" window may be presented on the display monitor).

A second API, an audio device selection API 224 also interfaces with the audio application 222 and further with the input and output ports or interfaces through which the microphone 202 and the loudspeaker 204 are connected to the computer system 200. (Although not depicted in FIG. 2, the audio application 222 may additionally interface with the audio rendering module 208 with a separate API to produce the sound from the audio session conducted by the audio application 222 (e.g., a VOIP telephone call) on the loudspeaker 204). The audio device selection API 224 activates the input port or output port connected with the audio devices desired for use with the audio application 222. For example as previously described with respect to FIG. 1, a user's computer system 200 may have a plurality of microphones 202, for example, a first microphone integrated into a display monitor and a second microphone integrated into a web camera, and a plurality of loudspeakers 204, for example, a first set of loudspeakers wired to the computer system 200 and a second set of loudspeakers integrated into the display monitor.

The audio application 222 may ask the user which microphone and set of loudspeakers the user would like to use for audio communication purposes. The audio application 222, through the audio device selection API 224, would open and close appropriate data ports to activate the desired microphone 202 and loudspeaker 204 combination. In the event that a configuration problem is detected by the device detection module 212, the audio application 222 may further invoke the audio device selection API 224 to automatically cycle through any available devices connected with the computer system 200 to locate a device that is configured appropriately.

Figure 3:
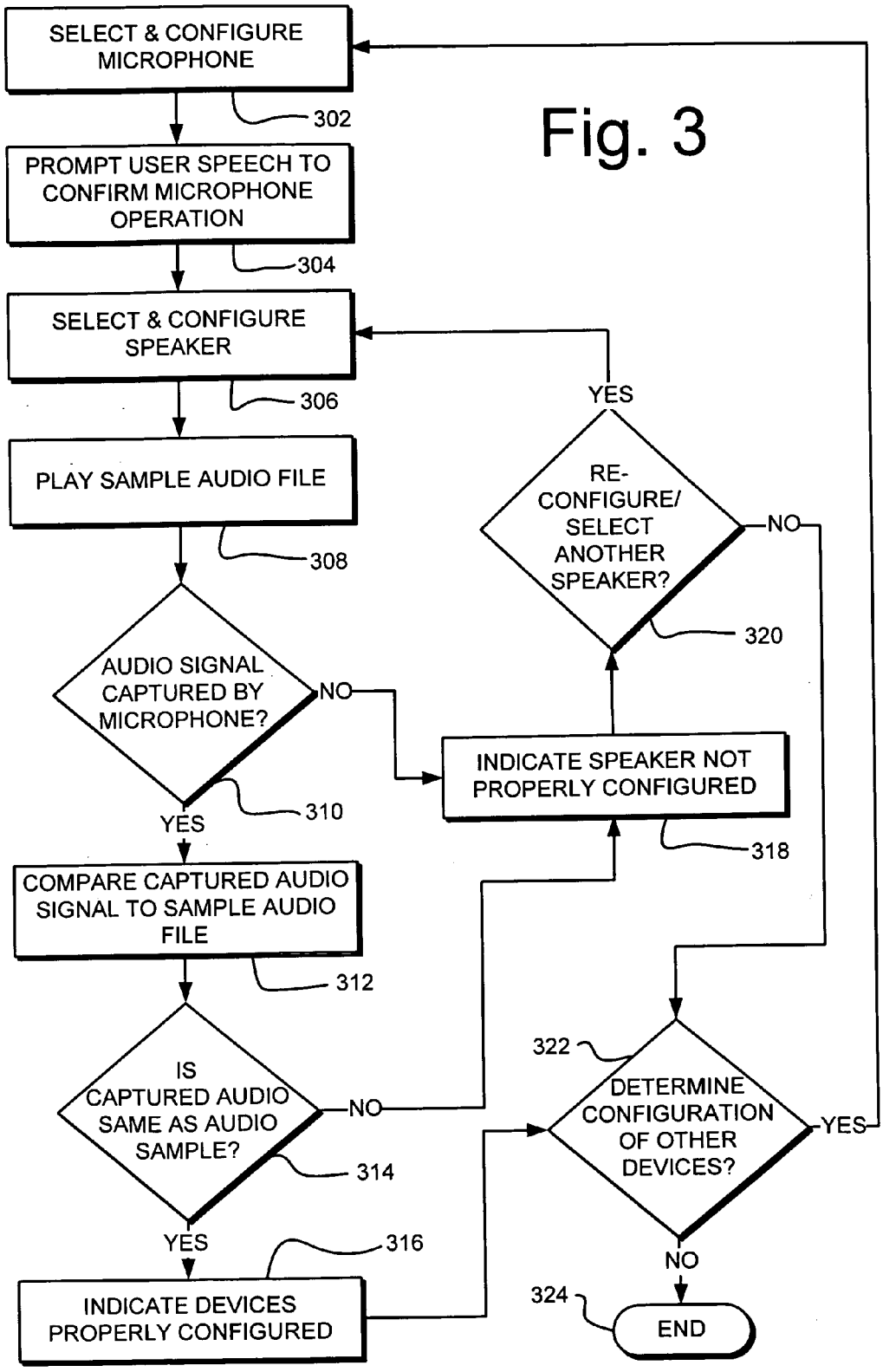
FIG. 3 illustrates a series of exemplary operations performed by the modules to detect device configuration.

An exemplary series of operations performed by a computer system to perform the automatic device detection functions is depicted in FIG. 3. In the context of the exemplary configuration of the computer system 200 of FIG. 2, the device detection module is configured to detect the operability of a loudspeaker connected with the computer system.

Initially, in a selection operation 302, the audio application prompts the user to select and configure a microphone for use in an audio session, e.g., an audio communication session. Once a microphone is selected (presuming more than one microphone is present), a prompting operation 304 requests that the user speak into the selected microphone to ensure functionality of the microphone. Such a prompt or request may be presented through a GUI message on a display monitor. Alternatively, the computer system may automatically select the microphone and automatically detect whether the microphone is picking up sound from the ambient environment. When the microphone is determined operational, a second selection operation 306 prompts the user to select and configure a loudspeaker (presuming more than one loudspeaker or set of loudspeakers is present). Alternatively, the computer system may automatically select a loudspeaker.

Once the user has selected a loudspeaker or the loudspeaker is otherwise automatically selected, a play operation 308 is initiated. In the play operation 308, the sample audio file is transmitted to the audio rendering device for playback through the selected loudspeaker. A query operation 310, e.g., as part of the signal detection module, interrogates the signal processor to determine whether any sound was detected by the microphone. If an audio signal corresponding to the microphone is returned by the signal processor, a comparing operation 312 compares the microphone audio signal to the sample audio file.

A second query operation 314 is performed to determine whether the microphone audio signal includes sound corresponding to the sample audio file. The audio signals need not be identical, but merely reasonably close. A threshold or range of value differences considered reasonably close may be predetermined or user-settable. If the audio signals are the same, an indication operation 316 indicates to the user, e.g., through a GUI message on a display monitor, that the chosen microphone and speakers are properly configured. A further optional query operation 322 may ask the user through a GUI message whether the user would like to determine the configuration of other devices. If so, the computer system returns to the selection operation 302 to select and configure an alternate microphone or alternate speakers. If the user does not wish to determine the configuration of other devices, the process terminates 324.

Returning to the first query operation 310, if the audio data from the signal processor indicates that no sound was captured by the microphone, an indication operation 318 alerts the user, e.g., via a GUI message, that the loudspeaker did not function or is otherwise improperly configured. The problem is presumed to be with the loudspeaker as it was previously determined that the microphone is functional in the first selection step 302. Similarly, if the second query operation 314 indicates that although sound was captured by the microphone, the sound does not correspond to the sample audio file, the indication operation 318 likewise alerts the user, e.g., via a GUI message, that the loudspeaker did not function or is otherwise improperly configured.

After notification of the loudspeaker configuration problem, another query operation 320 inquires whether the user wishes to either reconfigure the loudspeaker and test its operation again or select another loudspeaker to use instead. If the user desires to reconfigure or select a new loudspeaker, the process returns to the second selection operation 306 to select a new loudspeaker. If the user does not wish to select a new loudspeaker, a further query operation 322 may ask the user through a GUI message whether the user would like to determine the configuration of other devices.

Alternately, the query operation 322 may default to an automatic operation to seek out alternate loudspeakers in order to provide an operational audio device configuration for the user. If the user so desires or an automatic action is performed, the computer system returns to the selection operation 302 to select and configure an alternate microphone or alternate speakers. If the user does not wish to determine the configuration of other devices, the process terminates 324.

Figure 4:
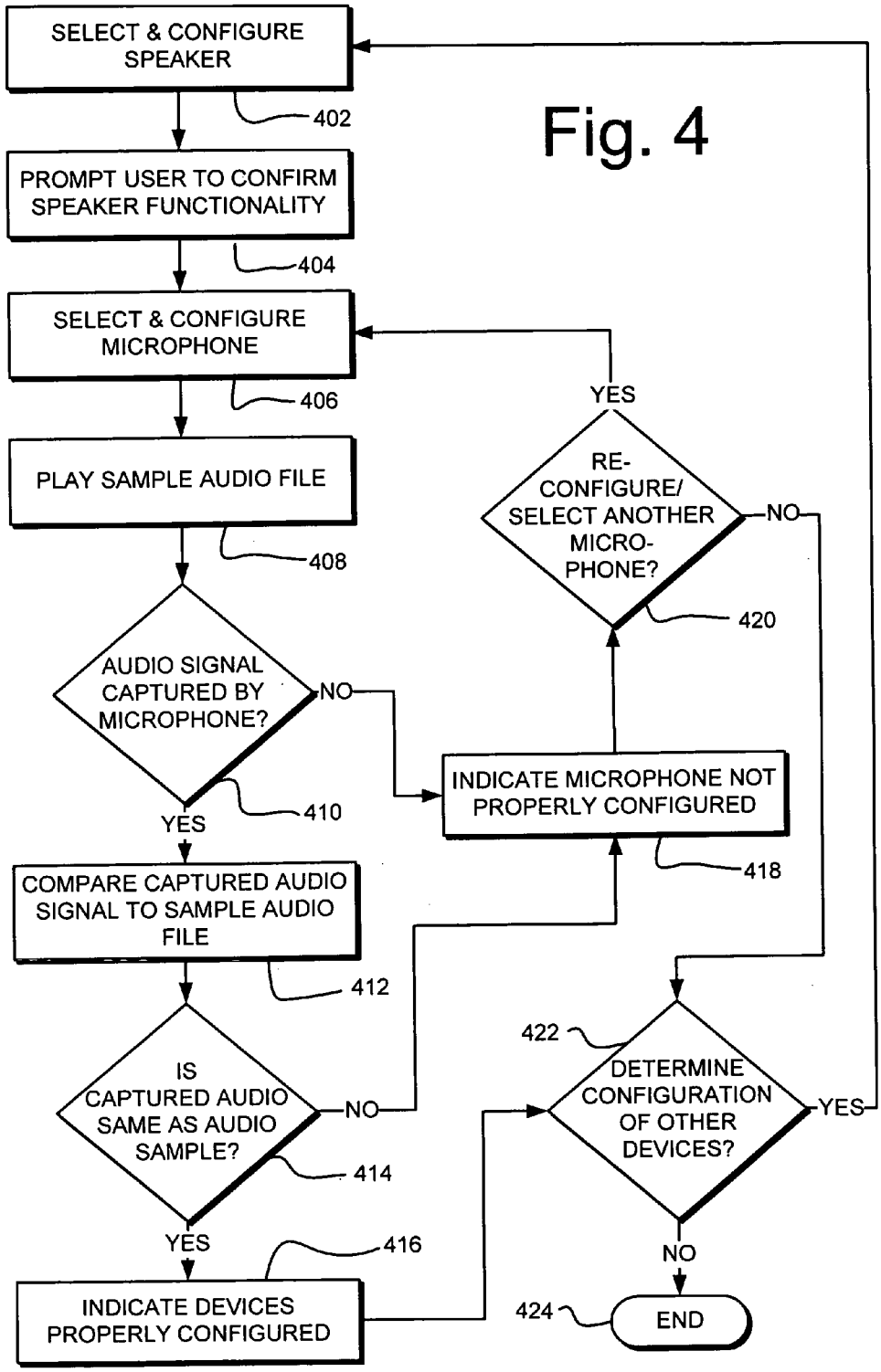
FIG. 4 illustrates another series of exemplary operations performed by the modules to detect device configuration.

An alternate series of operations performed by a computer system to perform the automatic device detection functions is depicted in FIG. 4. In the context of the exemplary configuration of the computer system of FIG. 2, the device detection module is configured to detect the operability of a microphone connected with the computer system. Such a series of operations may occur, for example, once a loudspeaker is detected as operational through the operations of FIG. 3 and a user desires to detect and configure additional audio devices. In this case, it is known that a particular loudspeaker is operational and thus an alternate microphone device can be automatically subject to detection. Alternately, the user may manually confirm the operability of a particular loudspeaker upon hearing audio output.

Initially, in a selection operation 402, the audio application prompts the user to select a preconfigured loudspeaker for use in an audio session, e.g., an audio communication session. Once a loudspeaker is selected (presuming more than one known loudspeaker is present), a prompting operation 404 requests that the user confirm the functionality of the loudspeaker for example, upon the playing of the sample audio signal. Such a prompt or request may be presented through a GUI message on a display monitor. When the loudspeaker is determined operational, a second selection operation 406 prompts the user to select and configure a microphone (presuming more than one microphone is present). Alternatively, the computer system may automatically select a microphone.

Once the user has selected a microphone or the microphone is otherwise automatically selected, a play operation 408 is initiated. In the play operation 408, the sample audio file is transmitted to the audio rendering device for playback through the selected loudspeaker. A query operation 410, e.g., as part of the signal detection module, interrogates the signal processor to determine whether any sound was detected by the microphone. If an audio signal corresponding to the microphone is returned by the signal processor, a comparing operation 412 compares the microphone audio signal to the sample audio file.

A second query operation 414 is performed to determine whether the microphone audio signal includes sound corresponding to the sample audio file. If the audio signals are the same, an indication operation 416 indicates to the user, e.g., through a GUI message on a display monitor, that the chosen microphone and speakers are properly configured. A further query operation 422 may ask the user through a GUI message whether the user would like to determine the configuration of other devices. If so, the computer system returns to the selection operation 402 to select and configure an alternate microphone or alternate speakers. If the user does not wish to determine the configuration of other devices, the process terminates 424.

Returning to the first query operation 410, if the audio data from the signal processor indicates that no sound was captured by the microphone, an indication operation 418 alerts the user, e.g., via a GUI message, that the microphone did not function or is otherwise improperly configured. The problem is presumed to be with the microphone as it was previously determined that the loudspeaker is functional in the first selection step 402. Similarly, if the second query operation 414 indicates that although sound was captured by the microphone, the sound does not correspond to the sample audio file, the indication operation 418 likewise alerts the user, e.g., via a GUI message, that the microphone did not function or is otherwise improperly configured.

After notification of the microphone configuration problem, another query operation 420 inquires whether the user wishes to either reconfigure the microphone and test its operation again or select another microphone to use instead. For example, the microphone may not have been detected due to poor placement with respect to the loudspeaker such that inadequate sound intensity reaches the microphone or excess sound intensity is causing feedback that obscures the ability to make a clear comparison between audio signals. If the user desires to reconfigure or select a new microphone, the process returns to the second selection operation 406 to select a new microphone. If the user does not wish to reconfigure or select a new microphone, a further query operation 422 may ask the user through a GUI message whether the user would like to determine the configuration of other devices.

Alternately, the query operation 422 may default to an automatic operation to seek out alternate microphones in order to provide an operational audio device configuration for the user. If the user so desires or an automatic action is performed, the computer system returns to the selection operation 402 to select and configure an alternate microphone or alternate speakers. If the user does not wish to determine the configuration of other devices, the process terminates 424.

The operations described herein may also be applied to other input device and output device configurations, for example, video, optical, or graphic output and input. In one implementation, the configuration of video devices, e.g., a video display and a video camera, may be detected. For example, a sample video signal may be output to the video display and a video camera with a charge coupled device (CCD) may be positioned to record the image presented on the video display. The image of the sample video signal from the image on the video display generated by the CCD in the video camera may be recorded and compared to the sample video image to detect the device configuration. In another implementation, the configuration of graphic input and output devices, for example, a scanner and a printer, may be configured. A sample graphic file may be output to a printer for rendering on paper or other physical medium. The printed image may then be introduced to the scanner, which may record the printed image for comparison to the sample graphic file. Other exemplary devices and configurations for detection are likewise possible.

Figure 5:
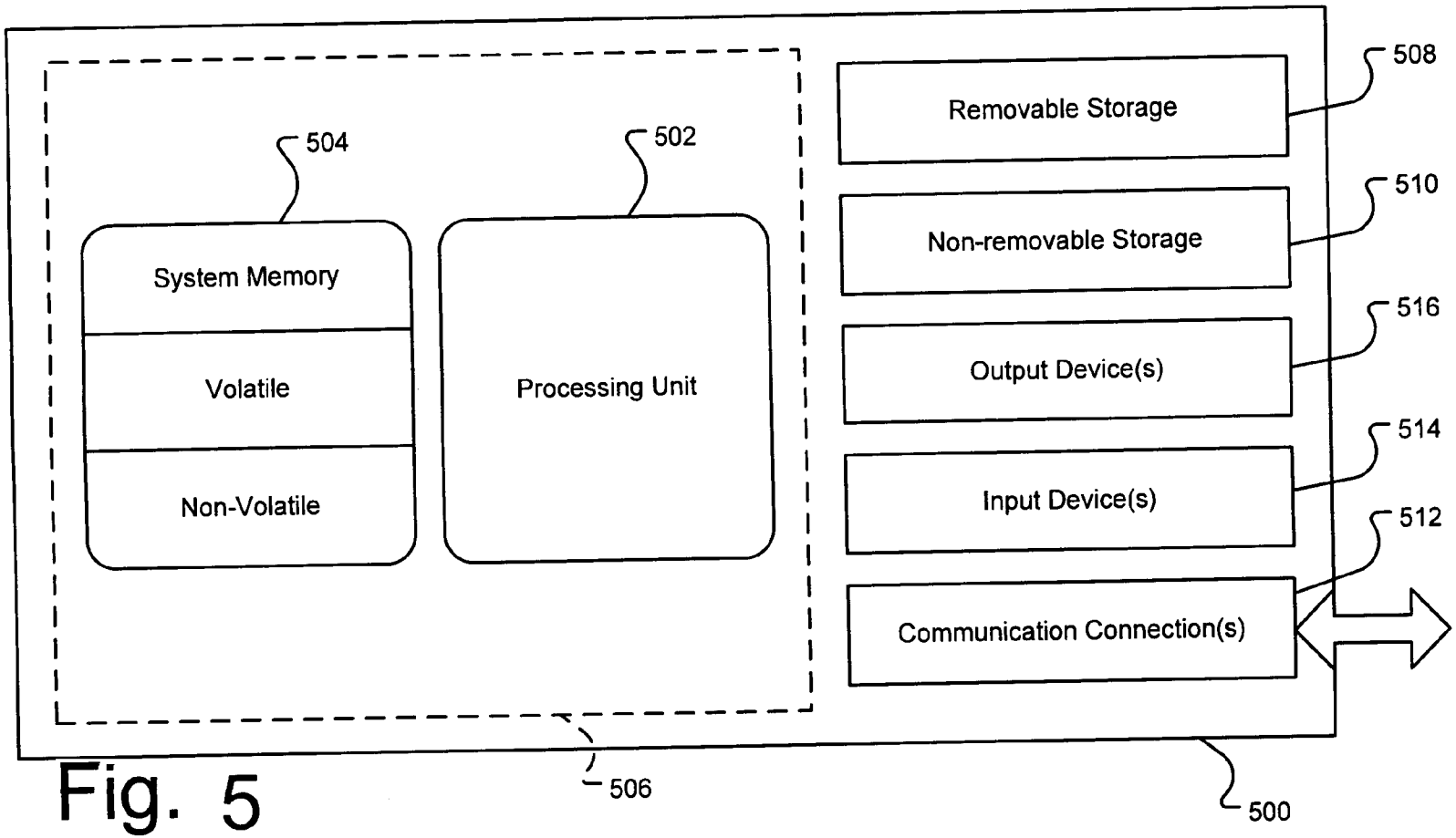
FIG. 5 illustrates an exemplary computer system for conducting real-time communication sessions and other audio input and output functions.

FIG. 5 illustrates an exemplary computer system 500 that may be used to conduct real-time communication sessions over a network and in which the detection technology described herein may operate. In one implementation, the computer system 500 may be embodied by a desktop or laptop computer, although other implementations, for example, video game consoles, set top boxes, portable gaming systems, personal digital assistants, and mobile phones may incorporate the described technology. The computer system 500 typically includes at least one processing unit 502 and memory 504. Depending upon the exact configuration and type of the computer system 500, the memory 504 may be volatile (e.g., RAM), non-volatile (e.g., ROM and flash memory), or some combination of both. The most basic configuration of the computer system 500 need include only the processing unit 502 and the memory 504 as indicated by the dashed line 506.

The computer system 500 may further include additional devices for memory storage or retrieval. These devices may be removable storage devices 508 or non-removable storage devices 510, for example, magnetic disk drives, magnetic tape drives, and optical drives for memory storage and retrieval on magnetic and optical media. Storage media may include volatile and nonvolatile media, both removable and non-removable, and may be provided in any of a number of configurations, for example, RAM, ROM, EEPROM, flash memory, CD-ROM, DVD, or other optical storage medium, magnetic cassettes, magnetic tape, magnetic disk, or other magnetic storage device, or any other memory technology or medium that can be used to store data and can be accessed by the processing unit 502. Information may be stored on the storage media using any method or technology for storage of data, for example, computer readable instructions, data structures, and program modules.

The computer system 500 may also have one or more communication interfaces 512 that allow the system 500 to communicate with other devices. The communication interface 512 may be connected with a local area network (LAN), a wide area network (WAN), a telephony network, a cable network, the Internet, a direct wired connection, a wireless network, e.g., radio frequency, infrared, microwave, or acoustic, or other networks enabling the transfer of data between devices. Data is generally transmitted to and from the communication interface 512 over the network via a modulated data signal, e.g., a carrier wave or other transport medium. A modulated data signal is an electromagnetic signal with characteristics that can be set or changed in such a manner as to encode data within the signal.

The computer system 500 may further have a variety of input devices 514 and output devices 516. Exemplary input devices 514 may include a keyboard, a mouse, a tablet, a touch screen device, a scanner, a visual input device, and a microphone or other sound input device. Exemplary output devices 516 may include a display monitor, a printer, and speakers. Such input devices 514 and the output devices 516 may be integrated with the computer system 500 or they may be connected to the computer system 500 via wires or wirelessly, e.g., via a Bluetooth protocol. These integrated or peripheral input and output devices are generally well known and are not further discussed herein. In one implementation, program instructions implementing the methods or the modules for determining audio quality, including, for example, the sample audio file, are embodied in the memory 504 and storage devices 508 and 510 and executed by processing unit 502. Other functions, for example, as performed by the audio rendering module and the audio capture module, may be performed by an operating system in the nonvolatile memory 504 of the computer system 500.

The technology described herein is implemented as logical operations and/or modules in one or more systems. The logical operations may be implemented as a sequence of processor-implemented steps executing in one or more computer systems and as interconnected machine or circuit modules within one or more computer systems. Likewise, the descriptions of various component modules may be provided in terms of operations executed or effected by the modules. The resulting implementation is a matter of choice, dependent on the performance requirements of the underlying system implementing the described technology. Accordingly, the logical operations making up the embodiments of the technology described herein are referred to variously as operations, steps, objects, or modules. Furthermore, it should be understood that logical operations may be performed in any order, unless explicitly claimed otherwise or a specific order is inherently necessitated by the claim language.

The above specification, examples and data provide a complete description of the structure and use of exemplary embodiments of the invention. Although various embodiments of this invention have been described above with a certain degree of particularity, or with reference to one or more individual embodiments, those skilled in the art could make numerous alterations to the disclosed embodiments without departing from the spirit or scope of this invention. In particular, it should be understand that the described technology may be employed independent of a personal computer. Other embodiments are therefore contemplated. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A method for detection of configuration of a device connected with a computer system, the method comprising:

a. transmitting during a time period a sample signal for output via an output device connected with the computer system;

b. capturing during the time period a captured signal via an input device connected with the computer system;

c. comparing the sample signal to the captured signal to determine whether the captured signal substantially corresponds to the sample signal thus indicating whether the output device, the input device, or both are operational;

d. automatically selecting a second configuration comprising at least one of: a second output device and a second input device, when the sample signal and the captured signal do not correspond substantially;

repeating a, b, c, and d for the second configuration; and automatically iterating a, b, c, and d for each configuration connected with the computer system until a configuration is located where the sample signal and the captured signal correlate for that configuration.

2. The method of claim 1 further comprising outputting the sample signal via the output device.

3. The method of claim 1, wherein the step of comparing further comprises processing at least one of the sample signal and the captured signal to transform the sample signal, the captured signal, or both into a common format.

4. The method of claim 1, wherein the output device comprises a loudspeaker and the input device comprises a microphone.

5. The method of claim 1, wherein the output device comprises a video display device and the input device comprises a video input device.

6. The method of claim 1, wherein the output device comprises a graphic output device and the input device comprises an optical input device.

7. The method of claim 1 further comprising providing an indication to a user of the computer system of the results of the comparing operation.

8. The method of claim 1, wherein either the output device comprises a plurality of output devices, the input device comprises a plurality of input devices, or both, and wherein the method further comprises iterating through the operations of claim 1 for each output device or input device connected with the computer system.

9. A computer-readable storage device having computer-executable instructions for performing a computer process implementing the method of claim 1.

10. A computer-readable storage device having computer-executable instructions for performing a computer process implementing the method of claim 8.

11. A method for detecting the configuration of a microphone or a loudspeaker connected with a computer system, the method comprising:

a. transmitting during a time period a sample audio signal from a sample audio file stored in a memory of the computer system for output via the loudspeaker;

b. capturing during the time period a captured sound via the microphone to produce a captured audio signal;

c. confirming if the microphone, the loudspeaker, or both are operational when the sample audio signal correlates with the captured audio signal;

d. automatically selecting a second configuration comprising at least one of: a second loudspeaker and a second microphone, when the sample signal and the captured signal do not correlate;

repeating a, b, c, and d for the second configuration; and automatically iterating a, b, c, and d for each loudspeaker and microphone configuration connected with the computer system until a configuration is located where the sample signal and the captured signal correlate for that configuration.

12. The method of claim 11 further comprising outputting a sample sound via the loudspeaker generated from the sample audio file.

13. The method of claim 11 further comprising providing an indication to a user of the computer system of the results of the confirming operation.

14. The method of claim 11, wherein either the loudspeaker comprises a plurality of loudspeakers, the microphone comprises a plurality of microphones, or both, and wherein the method further comprises iterating through the operations of claim 11 for each loudspeaker or microphone connected with the computer system.

15. A computer-readable storage device having computer-executable instructions for performing a computer process implementing the method of claim 11.

16. A computer system for automatic detection of configuration of a device connected with the computer system, the computer system comprising a processor;

a memory accessible by the processor and having a sample file;

an output device under control of the processor and capable of outputting a sample signal corresponding to the sample file during a time period;

an input device under control of the processor and capable of receiving a captured signal corresponding to the sample signal output by the output device during the time period, wherein either the output device comprises a plurality of output devices, the input device comprises a plurality of input devices, or both;

a device detection module under control of the processor that receives both the sample signal and the captured signal from the input device and is adapted to compare the sample signal to the captured signal to determine whether the captured signal substantially corresponds to the sample signal to determine whether the output device, the input device, or both are operational; and a device selection application adapted to automatically iterate through each output device of a plurality of output devices and input device of a plurality of input devices connected with the computer system, to output the sample file and receive the signal at each iteration, and to select a configuration of output device and input device when the sample signal output and the received captured signal correspond substantially.

17. The computer system of claim 16, further comprising a signal capture module for transforming an analog signal received by the input device into a digital signal.

18. The computer system of claim 16, wherein the processor further comprises a signal processor adapted to process at least one of the sample signal and the captured signal to transform the sample signal, the captured signal, or both into a common format.

19. The computer system of claim 16, wherein the input device further comprises a microphone and the output device further comprises a loudspeaker.

* * * * *